US012473824B2

(12) United States Patent
Zhan et al.

(10) Patent No.: US 12,473,824 B2
(45) Date of Patent: Nov. 18, 2025

(54) MUD PULSER

(71) Applicant: CHINA PETROLEUM & CHEMICAL CORPORATION, Beijing (CN)

(72) Inventors: Sheng Zhan, Houston, TX (US); Sam Seldon, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 232 days.

(21) Appl. No.: 18/326,849

(22) Filed: May 31, 2023

(65) Prior Publication Data

US 2024/0401475 A1 Dec. 5, 2024

(51) Int. Cl.
*E21B 47/18* (2012.01)
*E21B 47/24* (2012.01)

(52) U.S. Cl.
CPC ..... *E21B 47/18* (2013.01); *E21B 47/24* (2020.05)

(58) Field of Classification Search
CPC ..... E21B 47/18; E21B 47/24
See application file for complete search history.

(56) References Cited

U.S. PATENT DOCUMENTS

| | | | | |
|---|---|---|---|---|
| 6,016,288 | A | 1/2000 | Frith | |
| 7,467,658 | B2 | 12/2008 | Kent et al. | |
| 8,689,884 | B2 | 4/2014 | Young et al. | |
| 9,638,025 | B2 | 5/2017 | Pare et al. | |
| 2007/0284116 | A1 | 12/2007 | Hall et al. | |
| 2010/0243401 | A1 | 9/2010 | Diosi et al. | |
| 2017/0350202 | A1* | 12/2017 | Menconi | E21B 47/18 |
| 2018/0347350 | A1* | 12/2018 | Frith | E21B 47/24 |
| 2019/0211673 | A1 | 7/2019 | Gopalan | |
| 2019/0301267 | A1 | 10/2019 | Segura | |
| 2021/0340864 | A1 | 11/2021 | Zhan et al. | |
| 2023/0160303 | A1* | 5/2023 | Weber | E21B 47/18 166/373 |

* cited by examiner

*Primary Examiner* — Brad Harcourt
(74) *Attorney, Agent, or Firm* — NKL Law; Allen Xue

(57) ABSTRACT

A mud pulser includes an inlet assembly, a main-valve assembly, a servo-valve assembly, a motor assembly and a collar. The servo-valve assembly has a servo-valve, which includes a servo-valve plugging member and a servo-valve chamber housing the servo-valve plugging member and having a first orifice and a second orifice. A servo-valve shaft is connected to the servo-valve plugging member and configured to be driven to perform a reciprocating movement that causes the servo-valve plugging member to alternately block the first orifice and the second orifice. The alternate blocking of the first orifice and the second orifice triggers movements in the main-valve assembly to restrict or release mud flow to generate mud pulse.

9 Claims, 13 Drawing Sheets

MUD PULSER

FIELD OF TECHNOLOGY

The present disclosure relates to a mud pulser used in a drilling system to generate pulses in that drilling mud to transmit information from the borehole to the surface.

BACKGROUND

Oil and gas exploration and extraction uses a drilling system to deliver and guide a drill bit to the pay zone. Data collected by sensors during drilling needs to be transmitted up the borehole to the surface. Data is decoded/translated to information about parameters such as temperature, pressure, inclination or angle of the borehole, direction or azimuth of the borehole, and various geophysical parameters that are of interest and value during the drilling process.

Mud pulse telemetry is one of the methods to transmit data from borehole to the surface. LWD and MWD data are encoded, i.e., converted into amplitude- or frequency-modulated mud pulses, and sent up to the surface through a column of mud in the drill string to computer devices on the surface. Note that the pulses in the mud are in fact pressure pulses detectable by pressure sensors installed on the surface. "Mud pulse(s)" and "pressure pulse(s)" are used interchangeably. One or more computing device located on the surface then decodes the modulated mud pulses and obtains information about subsurface formation properties. A pulser (or mud pulser) is a device that causes the formation of the modulated mud pulses. An example the pulser can be found in U.S. Patent Application Publication No. US 2021/0340864 A1.

Drilling deeper wells put more demands on the mud pulser. Mud pulsers shall sustain high temperature, high pressure, and generate strong pulsers but, preferably, consume less power. Accordingly, there is a need for a new pulser for efficiently and reliably generating and transmitting pressure pluses through the drilling fluid to a pressure sensor located on the surface.

SUMMARY

In one aspect of an embodiment of this disclosure, a mud pulser includes an inlet assembly, a main-valve assembly, a servo-valve assembly, a motor assembly and a collar. The inlet assembly lets in mud to flow. The main-valve assembly includes a main valve, a main-valve shaft and a main-valve conduit. The main valve includes a main-valve plugging member, a main valve seat that is adapted to receive the main-valve plugging member, and a main-valve chamber that houses the main-valve plugging member. The main-valve shaft affixes the main-valve plugging member thereto. The main-valve conduit is arranged in the main-valve shaft and connected to the inlet assembly. The servo-valve assembly includes a servo-valve, a servo-valve shaft and a servo-valve conduit. The servo-valve includes a servo-valve plugging member, and a servo-valve chamber that houses the servo-valve plugging member and has a first orifice and a second orifice. The servo-valve shaft is connected to the servo-valve plugging member, and configured to be driven to perform a reciprocating movement that causes the servo-valve plugging member to alternately block the first orifice and the second orifice. The servo-valve conduit is connected to the servo-valve chamber and the main-valve assembly. The motor assembly includes a motor connected to the servo-valve shaft and driving the servo-valve shaft to perform the reciprocating movement. The collar houses the inlet assembly, the main-valve assembly, the servo-valve assembly and the motor assembly. The collar forms a mud channel therein about the main-valve assembly, the servo-valve assembly and the motor assembly.

In one aspect of the embodiment, the main valve is configured to cause pressure pulses to be generated through pressure of the mud toward the inlet assembly where the pressure of the mud is caused by the mud flowing from the servo-valve chamber through the servo-valve conduit when the servo-valve plugging member blocks the second orifice.

In one aspect of the embodiment, the main valve is configured to cause the mud to flow through the mud channel from the main-valve assembly toward the servo-valve assembly when the servo-valve plugging member blocks the second orifice.

In one aspect of the embodiment, the inlet assembly further includes a filter screen through which a portion of the mud flows into the main-valve conduit from the mud channel.

In one aspect of the embodiment, the main-valve assembly further includes a piston that is affixed to the main-valve shaft, and a piston chamber that houses the piston and is connected to the servo-valve chamber.

In one aspect of the embodiment, the main-valve assembly further includes a spring that is housed in the piston chamber.

In one aspect of the embodiment, the piston is mounted on the main-valve shaft in such a manner as to give thrust force to the main-valve shaft. The spring is arranged in such a manner as to give thrust force to the piston by being compressed by the pressure of the mud in a direction of the reciprocating movement of the main-valve shaft.

In one aspect of the embodiment, the mud pulser further includes a landing ring that is affixed to an inner surface of the collar, is connected to either the servo-valve assembly or the motor assembly, and has an opening for enabling the mud channel to extend therethrough.

BRIEF DESCRIPTION OF DRAWINGS

The teachings of the present disclosure can be readily understood with reference to following detailed description in view of the accompanying drawings.

10—mud pulser; 100—mud channel; 110—inlet assembly; 111—filter screen; 112—inlet conduit; 113—spear; 120—main-valve assembly; 121—main valve; 122—main-valve shaft; 123—main-valve conduit; 124—main-valve plugging member; 1241—bypass port; 125 main-valve seat; 126—main-valve chamber; 127—piston; 128—piston chamber; 129—spring; 130—servo-valve assembly; 131—servo-valve; 132—servo valve shaft; 133—servo-valve conduit; 134—servo-valve plugging member; 135—servo-valve chamber; 136—first orifice; 137—second orifice; 138—exit hole; 140—motor assembly; 141—motor; 150—collar; and 160—landing ring.

DETAILED DESCRIPTION

Figure 1:
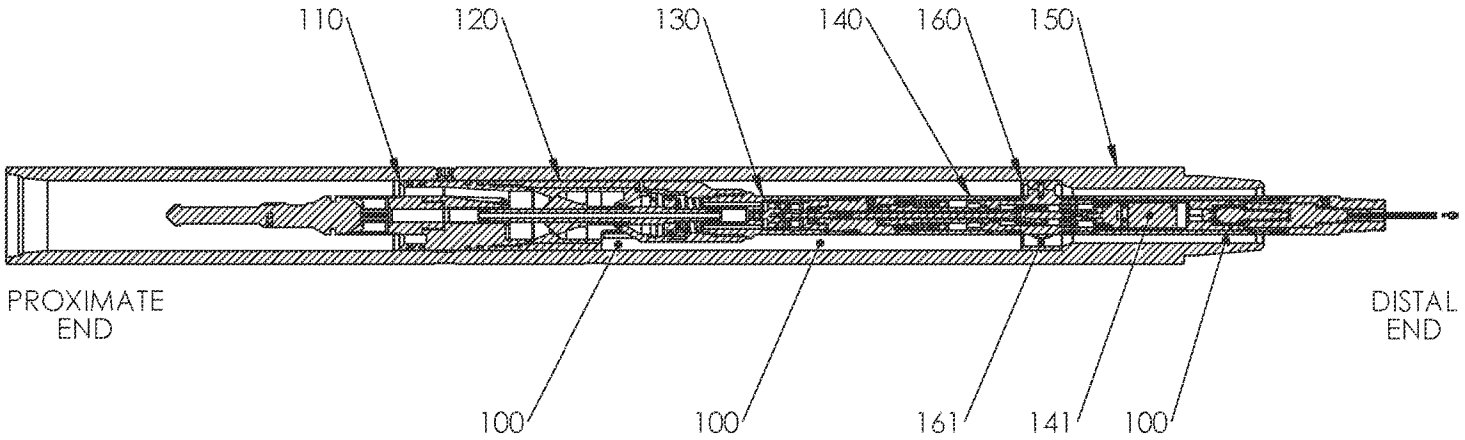
FIG. 1 is a sectional view of a mud pulser according to an exemplary embodiment.

FIG. 1 shows a sectional view of a mud pulser 10 according to an exemplary embodiment. The mud pulser 10 includes an inlet assembly 110, a main-valve assembly 120, a servo-valve assembly 130, and a motor assembly 140 that are serially connected and disposed in a collar 150. The collar 150 has an annular shape with a proximate end that are closer to the surface during operation and a distal end that is disposed away from the surface during operation.

Figure 2:
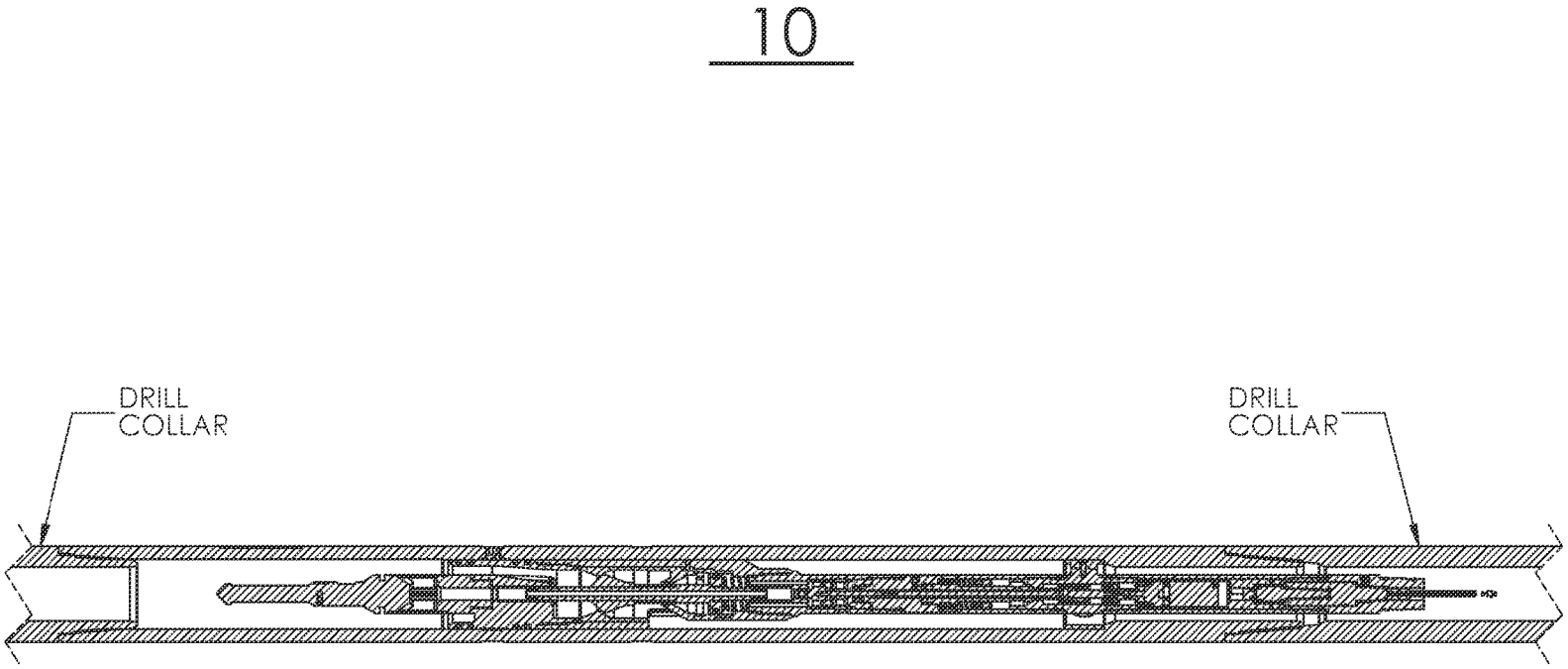
FIG. 2 is a sectional view of the mud pulser illustrated in FIG. 1 connected to other collars at both ends.

The motor assembly 140 includes a motor 141. A mud channel 100 is formed in the collar 150 about the main-valve assembly 120, the servo-valve assembly 130 and the motor assembly 140 inside the collar 150. The collar 150 is connectable to other collars as a part of the drill string. In FIG. 1, the mud pulser 10 is not connected to any other collars. On the other hand, in FIG. 2, the mud pulser 10 is connected to one collar at its distal end and another collar at its proximate end. The size and material of the collar 150 are suitable for specific drilling operations, such as depth, mud flow rate, etc.

The mud pulser 10 further includes a landing ring 160 in this exemplary embodiment. The landing ring 160 is affixed to an inner surface of the collar 150, and connected to the motor assembly 140. The landing ring 160 has an opening 161 for enabling the mud channel 100 to extend therethrough. A landing ring having a diameter different from the diameter of the landing ring 160 enables the servo-valve assembly 130 or the motor assembly 140 to fit in a collar having a diameter different from the diameter of the collar 150.

Figure 3:
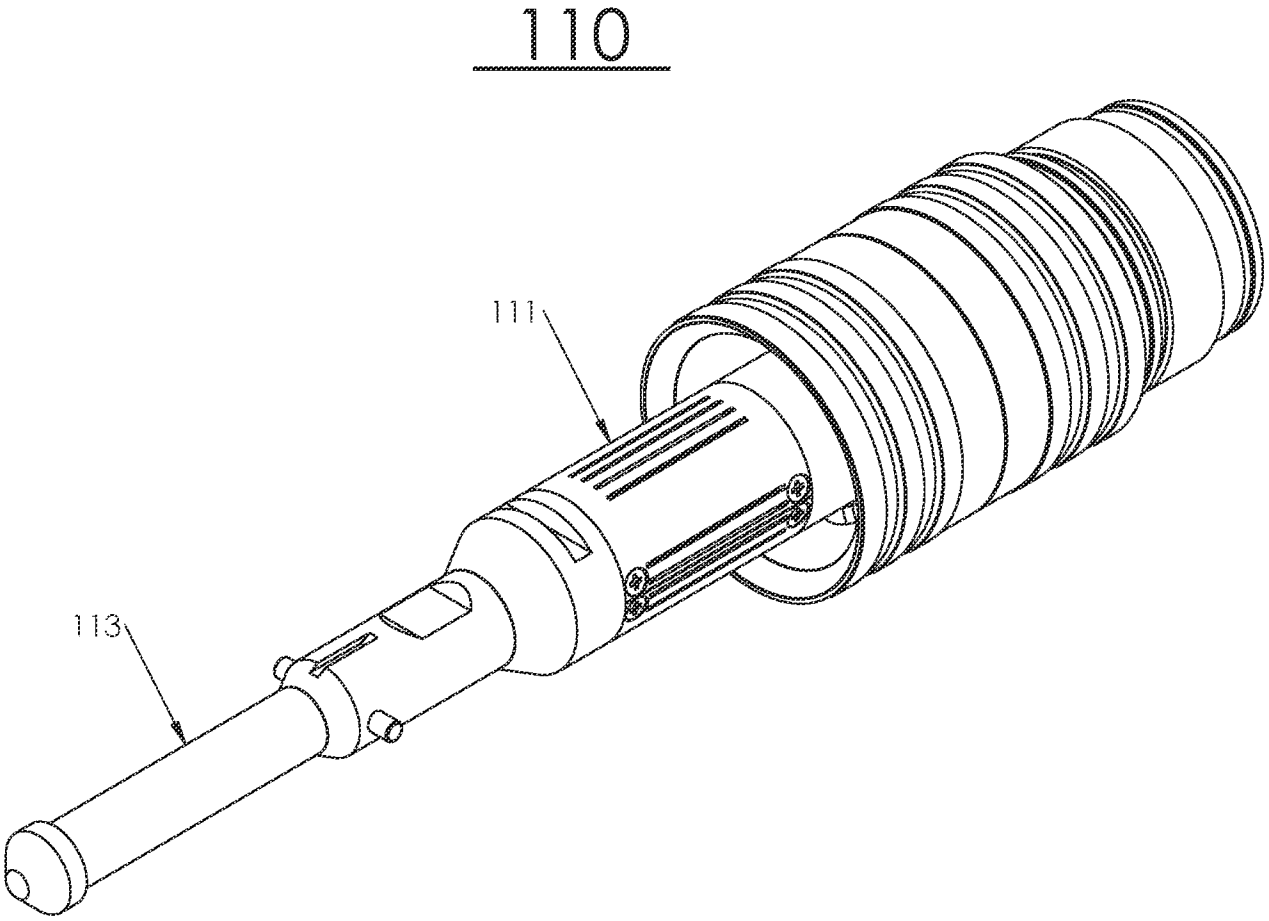
FIG. 3 is a perspective view of the inlet assembly of the mud pulser illustrated in FIG. 1.
Figure 4:
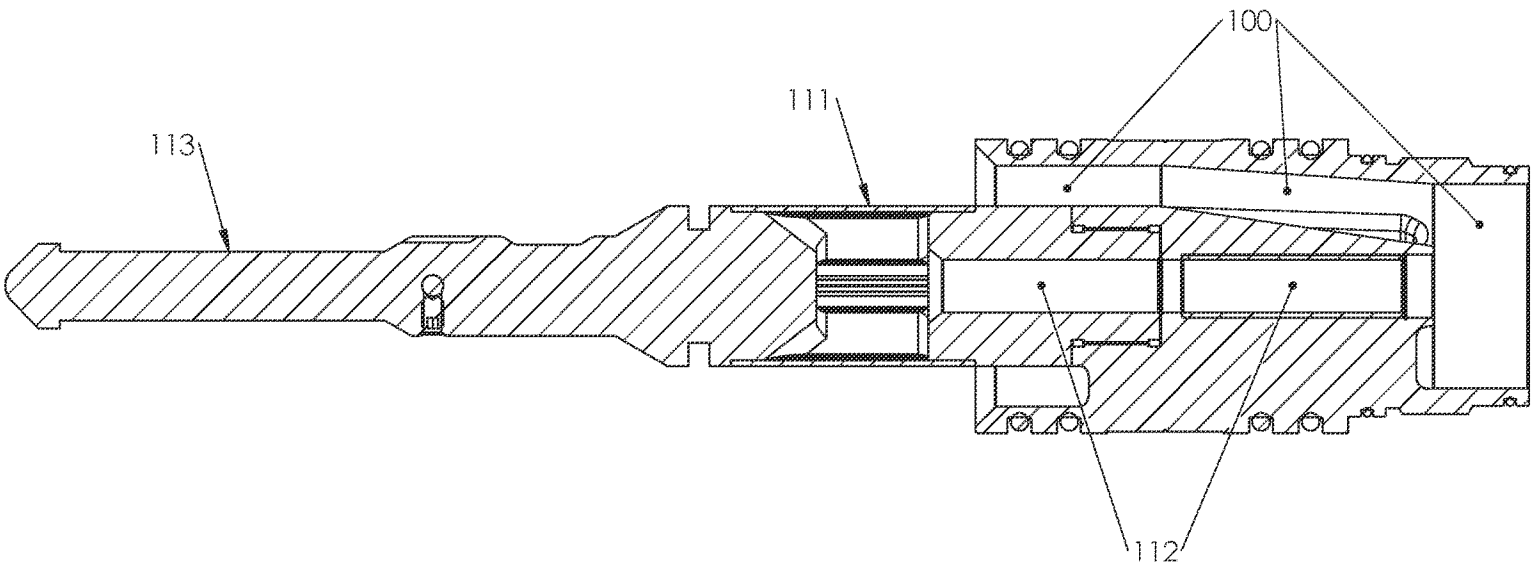
FIG. 4 is a sectional view of the inlet assembly illustrated in FIG. 3.

FIGS. 3 and 4 illustrate a perspective view and a sectional view of the inlet assembly 110 of the mud pulser 10, respectively. The inlet assembly 110 includes a filter screen 111, an inlet conduit 112, and a spear 113. The inlet screen 111 prevents debris from entering the inlet conduit 112, which channels the mud flow to the main-valve assembly 120. The spear 113 is a component to be used for installing the pulser into and removing the pulser form the collar 150, among other functions. A mud channel 100 is isolated from the inlet conduit 112 when the pulser is assembled and in operation. The mud channel 100 opens to the inside of the collar and receives the majority of the mud flow.

Figure 5:
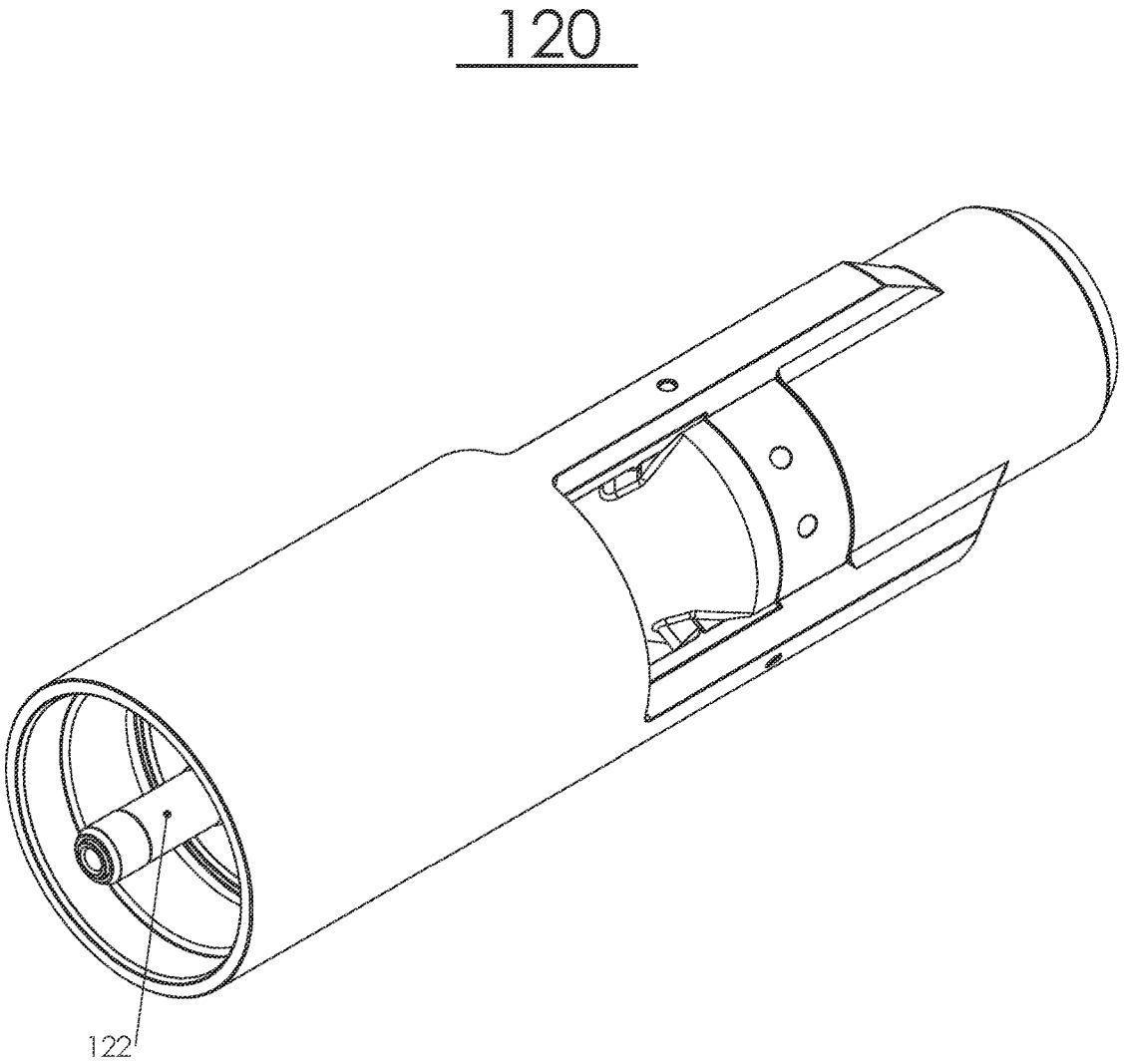
FIG. 5 is a perspective view of the main-valve assembly of the mud pulser illustrated in FIG. 1.
Figure 6A:
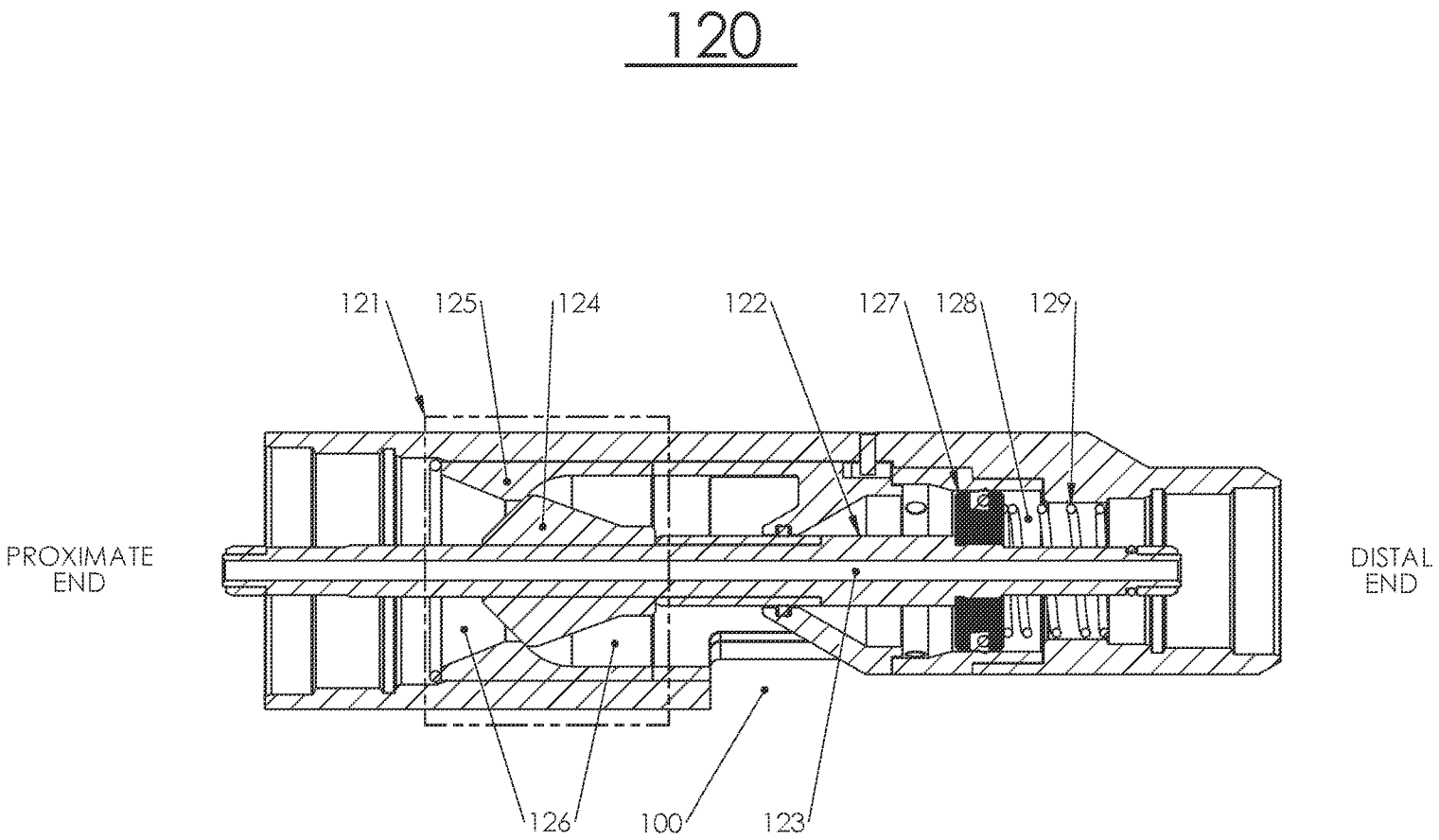
FIG. 6A is a sectional view of the main-valve assembly illustrated in FIG. 5.

FIGS. 5 and 6A respectively illustrate a perspective view and a sectional view of the main-valve assembly 120 of the mud pulser 10. The main-valve assembly 120 includes a main valve 121 and a main-valve shaft 122 extends thorough the main-valve assembly. The hollow center of the main-valve shaft 122 serves as a main-valve conduit 123 for mud flow.

Figure 6B:
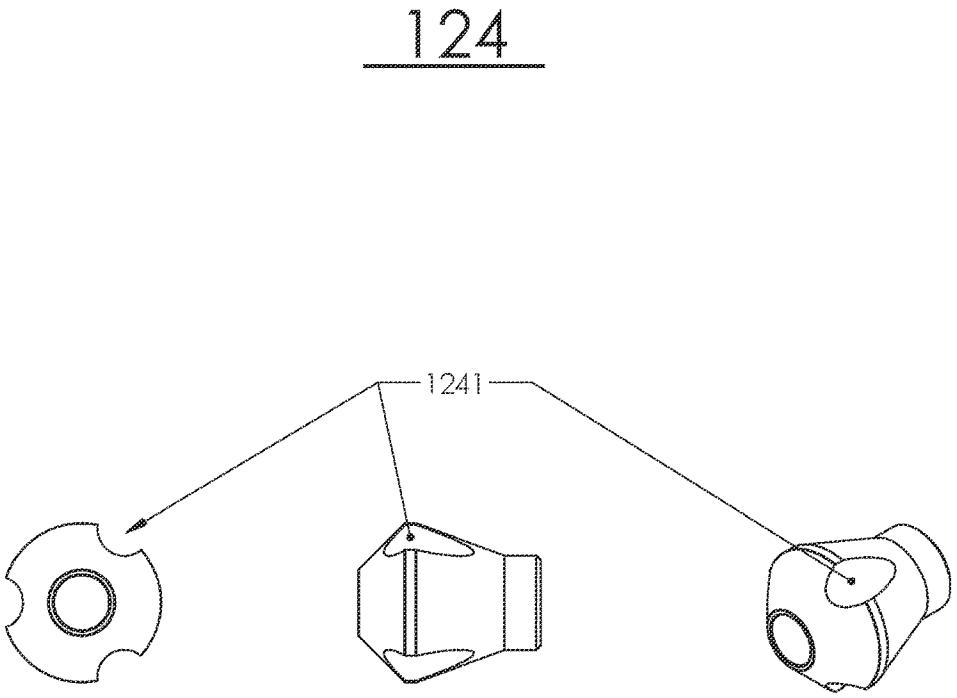
FIG. 6B provides detailed views of the main-valve plugging member.

The main valve 121 also includes a main-valve plugging member 124 sleeved on the main-valve shaft 122 and disposed in the main-valve chamber 126. FIG. 6B provides detailed views of the main-valve plugging member 124. Note that there are several grooves 1241 on the proximate surface of the plugging member 124. Those grooves forms bypass ports when the plugging member 124 engages the main valve seat 125 so that a small portion of the mud flow passes through the bypass ports into the main-valve chamber 126 and onward to the mud channel 100. Therefore, when the main valve 121 is closed, the plugging member 124 restricts the mud flow without totally blocking it.

When the main-valve plugging member 124 disengages from the main-valve seat 125, it opens the main valve so that the mud flow may pass through the main valve 121 without restriction, e.g., with minimal restriction as the design allows. Accordingly, the movement of main-valve plugging member 124 restricts or relaxes the mud flow alternately, which creates pressure pulses in the mud flow.

Note that the main-valve conduit 123 is arranged in the main-valve shaft 122 and connected to the inlet assembly 110, which allows a slip stream of mud flow to enter the conduit 123. A majority of the mud flow, however, may flow through the mud channel 100 in the inlet assembly, fills the main-valve chamber 126, and continue to flow into the collar downstream. In this context, the main-valve chamber 126 can be considered a portion of the mud channel 100.

The main-valve plugging member 124 is affixed to the main-valve shaft 122, which abuts the piston 127. The piston 127 in turn is in contact with a spring 129, which resides in the piston chamber 128. The operation of the main valve 121 is explained elsewhere in this document. It suffices to say that the piston 127 is configured to move back and forth, causing the main-valve plugging member 124 to engage or disengage the valve seat 125, which closes or opens the main valve 121. The stroke length of the main-valve plugging member may vary in the range of 0.25" to 0.75", for example, 0.50", according to different designs.

In this document, the state of the main valve 121 when the main-valve plugging member 124 is disengaged from the main valve seat 125 is defined as the open position, whereas the position of the main valve 121 where the main-valve plugging member 124 is engaged with the main valve seat 125 is defined as the closed position for the main valve 121.

Figure 7:
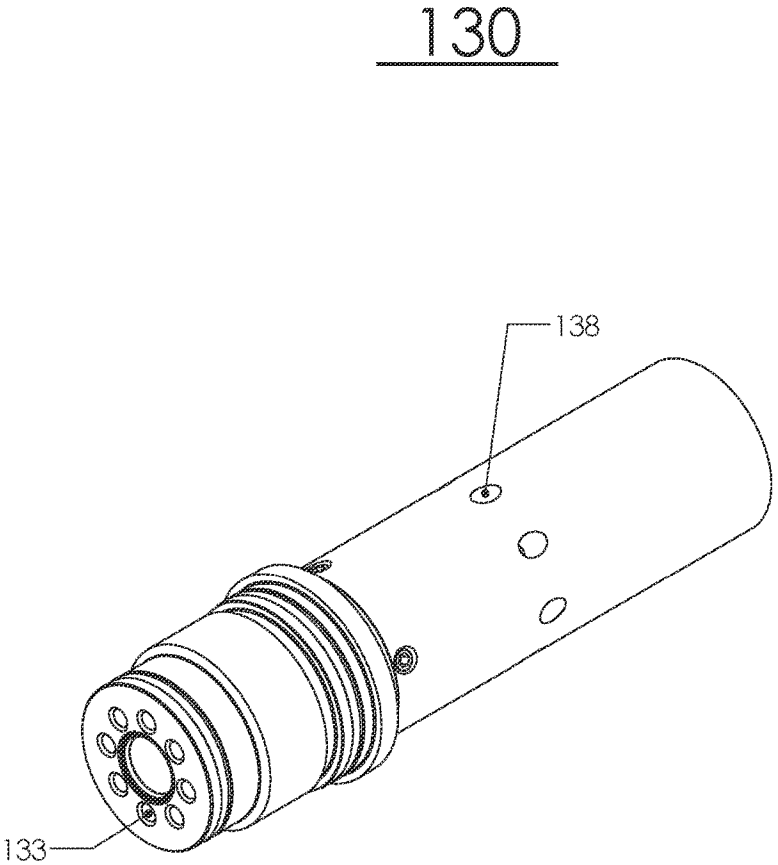
FIG. 7 is a perspective view of the servo-valve assembly of the mud pulser illustrated in FIG. 1.
Figure 8:
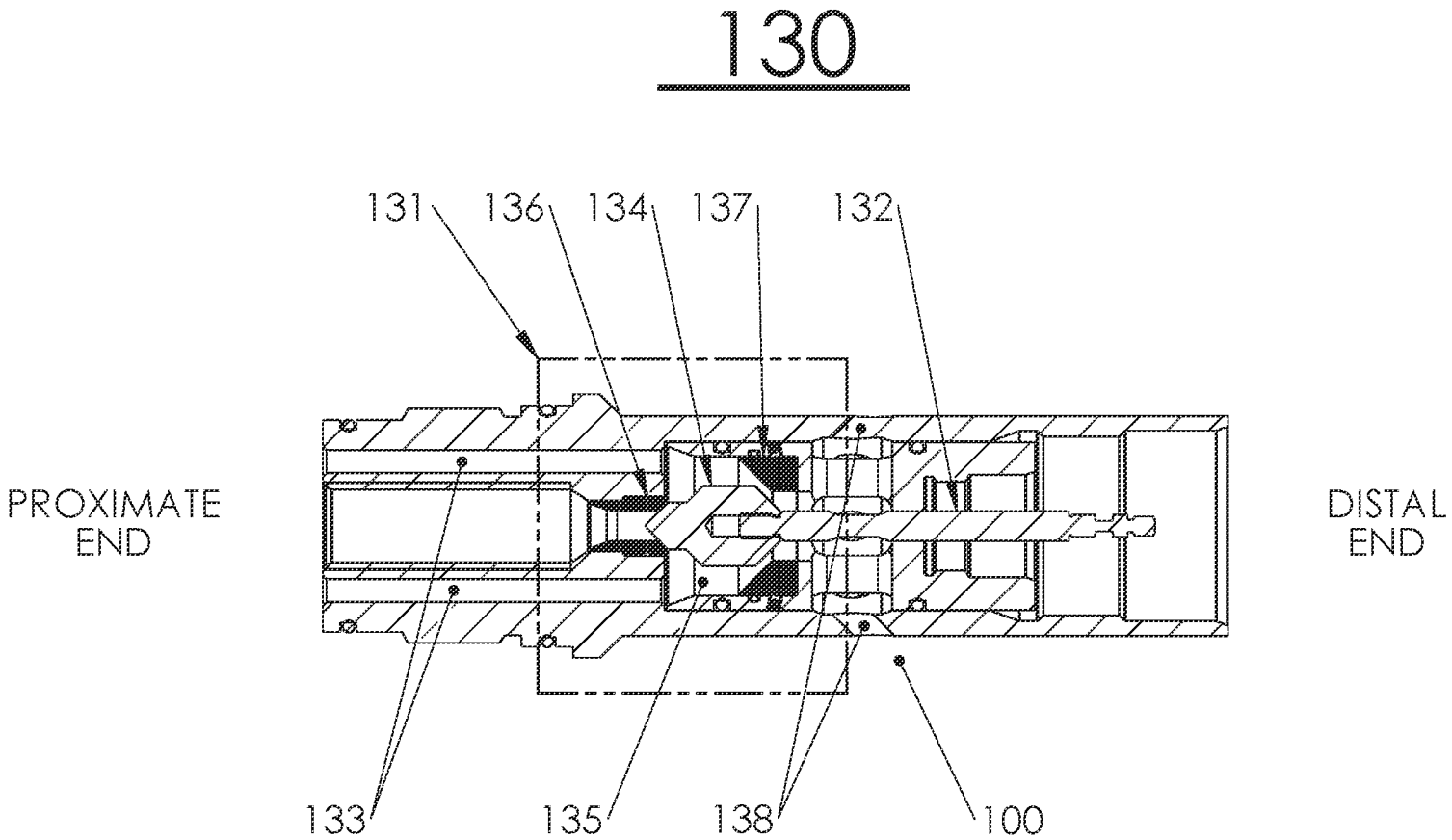
FIG. 8 is a sectional view of the servo-valve assembly illustrated in FIG. 7.

FIGS. 7 and 8 respectively illustrate a perspective view and a sectional view of the servo-valve assembly 130 of the mud pulser 10. The servo-valve assembly 130 includes a servo-valve 131, a servo-valve shaft 132 and several servo-valve conduits 133. The servo-valve 131 includes a servo-valve plugging member 134 and a servo-valve chamber 135. The servo-valve chamber 135 is connected to the piston chamber 128 through the servo-valve conduits 133. The servo-valve chamber 135 also houses the servo-valve plugging member 134. It has a first orifice 136 on this proximate side and a second orifice 137 on its distal side. The servo-valve chamber 135 is also connected to the mud channel 100 via the second orifice 137 and a plurality of exit holes 138 in an outer wall of the servo-valve assembly 130. The servo-valve shaft 132 is connected to the servo-valve plugging member 134 at its proximate end and the motor 141 at its distal end.

In this embodiment, the servo-valve plugging member 134 is a poppet having two pointed ends. The proximate end of the poppet is designed to engage and close the first orifice 136. The distal end of the poppet is designed to engage and close the second orifice 137. The state of the servo-valve 131 where the servo-valve plugging member 134 blocks the first orifice 136 is defined as the closed position while the state of the servo-valve 131, whereas the state in which the servo-valve plugging member 134 blocks the second orifice 137 is defined as an open position.

Operations of the mud pulser 10 thus constructed are explained below. During operation, a majority of the mud flow fills the mud channel 100 in the inlet assembly 110, fills the main-valve chamber 126, and exerts a pressure on the main-valve plugging member 124. On the other hand, a smaller portion of the mud flow in the collar enters the inlet assembly 110 through filter screen 111, filling the inlet conduit 112 and the main-valve conduit 123 of the main-valve assembly 120, and reaches the servo-valve chamber 135 when the first orifice 136 is open. When the second orifice 137 is blocked by the servo-valve plugging member 134, the mud flow enters the piston chamber 128 through the servo-valve conduits 133. The mud flow thereby pressures the piston 127, which in turn exerts a counter pressure on the main-valve plugging member 124 to close the main valve 121.

The motor 141 drives servo-valve shaft 132 to cause the servo-valve plugging member 134 to reciprocate in the servo-valve chamber, alternately blocking the first orifice and the second orifice. The blocking the first orifice reduces the counter pressure and opens the main valve 121, while blocking the second orifice increases the counter pressure and closes the main valve 121. The changes in the relative magnitude of the pressure and the counter pressure on the main valve plugging member 124 causes it to reciprocate back and forth, restricting and relaxing the mud flow to create pulsation.

Figure 9:
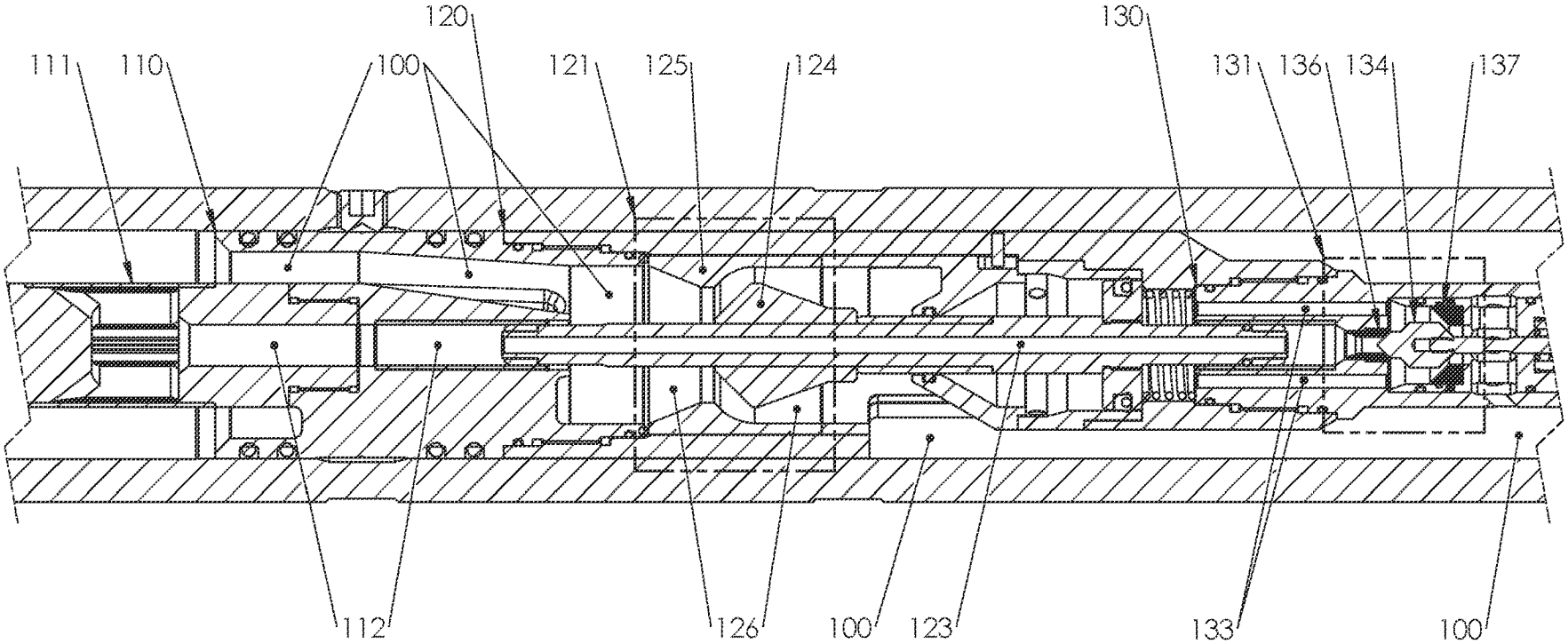
FIG. 9 is a partial sectional view of the mud pulser illustrated in FIG. 1 showing the servo valve of the servo-valve assembly in the closed position and the main valve of the main-valve assembly in the open position.

FIG. 9 illustrates a situation where the servo-valve 131 is in the closed position, and the main valve 121 is in the open position. When the servo-valve 131 is in the closed position (the position where the servo-valve plugging member 134 blocks the first orifice 136), the mud flowing from the inlet assembly 110 through the main-valve conduit 123 cannot flow further beyond the servo-valve plugging member 134. Further, since the main valve 121 is in the open position (the position where the main-valve plugging member 124 is detached from the main valve seat 125), the mud flows through the main-valve assembly 120 and the servo-valve assembly 130 via the main-valve chamber 126 in the mud channel 100.

Figure 10:
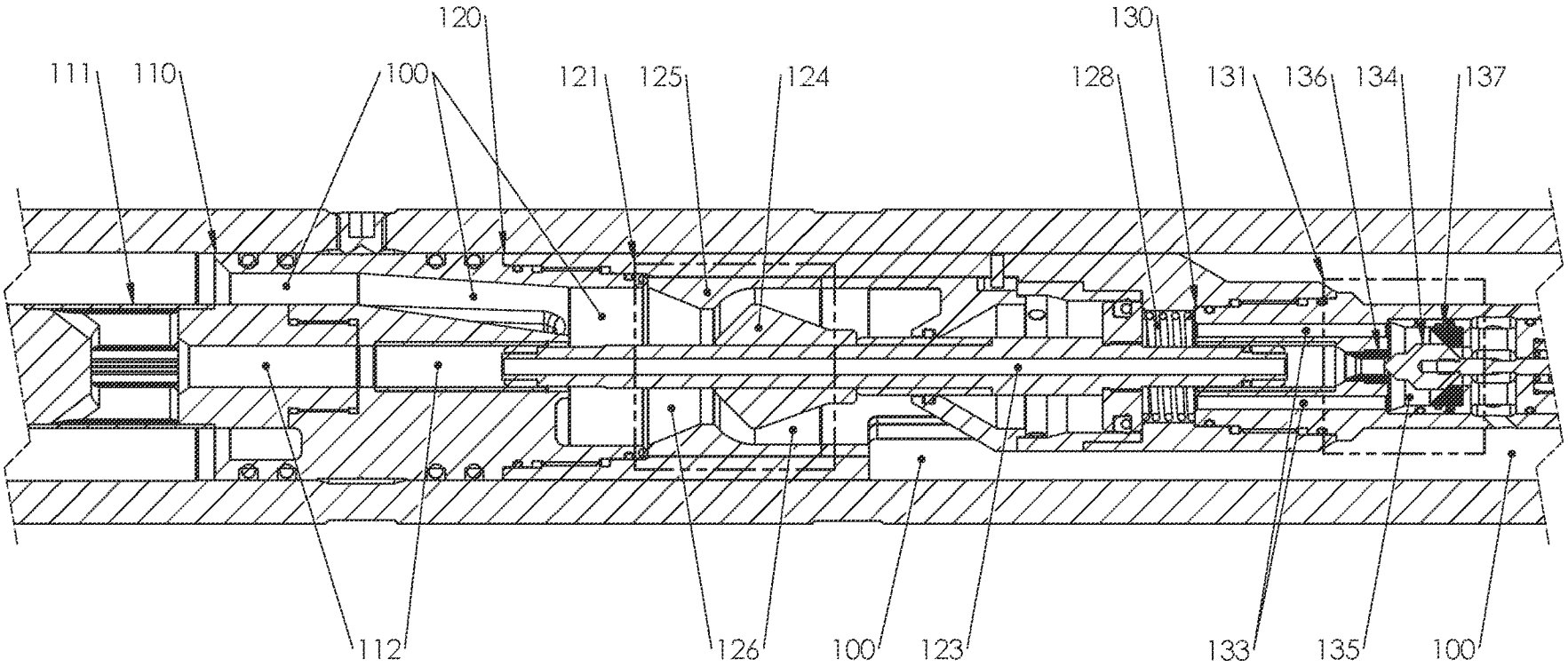
FIG. 10 is a partial sectional view of the mud pulser illustrated in FIG. 1 showing the servo valve in the open position and the main valve in the open position.

FIG. 10 illustrates a situation where the servo-valve 131 is in the open position and the main valve 121 is in the open position. As the servo-valve 131 is in the open position (a position where the servo-valve plugging member 134 blocks the second orifice 137), the mud flows further beyond the servo-valve plugging member 134 into the servo-valve chamber 135 but the mud cannot exit the servo-valve chamber 135 because the second orifice 137 is blocked by the servo-valve plugging member 134. The mud in the servo-valve chamber 135 then flows into the piston chamber 128 through the servo-valve conduits 133. At the same time, the main valve 121 is in the open position, the mud flows through the main-valve assembly 120 and the servo-valve assembly 130 via the main-valve chamber 126 in the mud channel 100 in the same manner as illustrated in FIG. 9.

Figure 11:
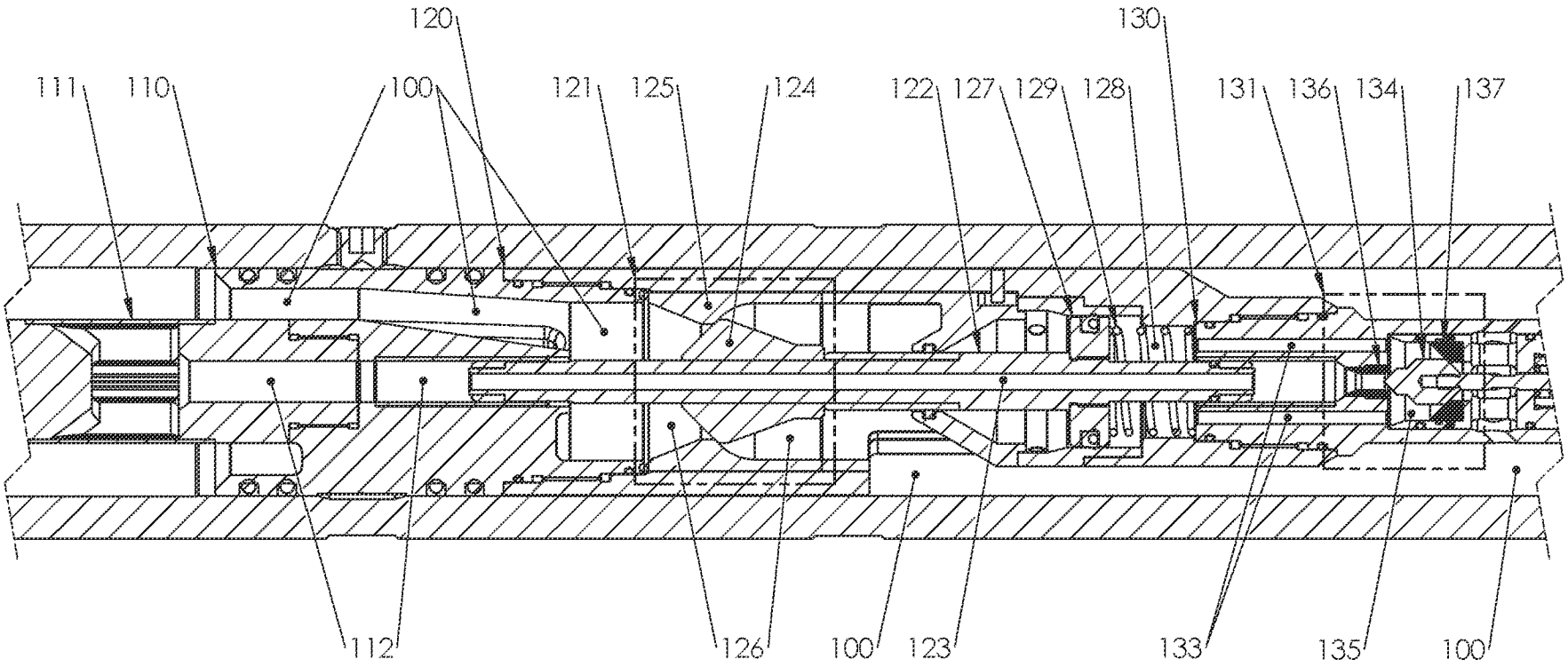
FIG. 11 is a partial sectional view of the mud pulser illustrated in FIG. 1 showing the servo valve in the open position and the main valve in the closed position.

FIG. 11 illustrates a situation where the servo-valve 131 is in the open position, and the main valve 121 is in the closed position. This situation occurs following the mode of operation illustrated in FIG. 10. Specifically, as the pressure of the mud flowing from the servo-valve chamber 135 into the piston chamber 128 becomes higher, the piston 127 moves toward the inlet assembly 110. When the pressure of the compressed spring 129 coupled with the pressure of the mud flowing from the servo-valve chamber 135 into the piston chamber 128 reaches a certain threshold pressure, the main-valve plugging member 124 engages the main valve seat 125, thereby putting the main valve 121 in the closed position. When the main valve 121 is caused to transition from the open position to the closed position, the mud that flows in the mud channel 100 becomes restricted as it enters the main-valve chamber 126. Such a restriction of the mud flow creates a pressure surge in the mud flow to form a mud pulse.

Figure 12:
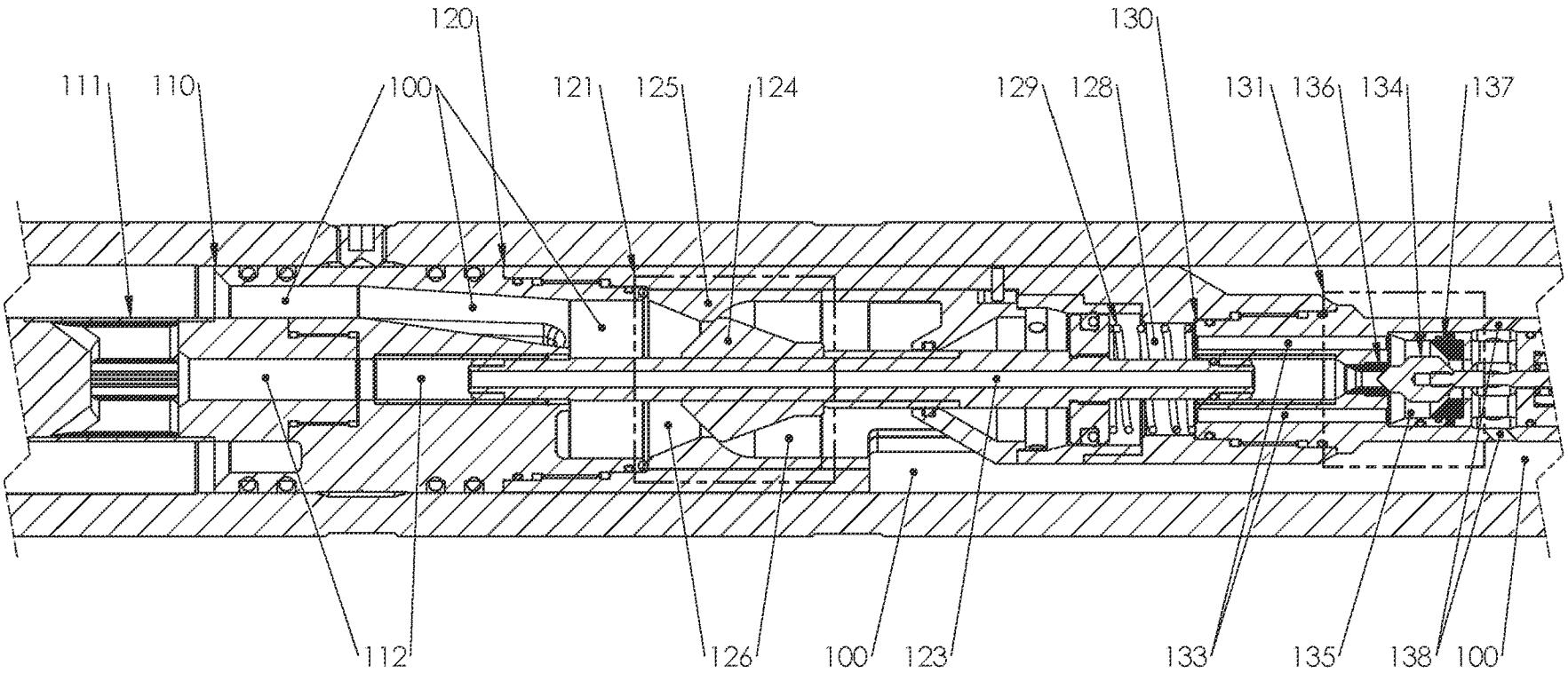
FIG. 12 is a partial sectional view of the mud pulser illustrated in FIG. 1 showing that the servo valve in the closed open position and the main valve in the closed position.

FIG. 12 illustrates a situation where the servo-valve 131 is in the closed position and the main valve 121 is in the closed position. When the servo-valve 131 is in the closed position, the mud in the servo-valve conduit 133 and the servo-valve chamber 135 is caused to flow through the mud channel 100 via the second orifice 137 and exit holes 138 in the outer wall of the servo-valve assembly 130 because the first orifice 136 is closed when the servo-valve 131 is in the closed position. The situation releases the pressure of the piston chamber 128 so that the pressure of the compressed spring 129 coupled with the pressure of the mud flowing from the servo-valve chamber 135 into the piston chamber 128 becoming lower than the certain threshold pressure. The main-valve plugging member 124 is then caused to be detached from the main valve seat 125, thereby putting the main valve 121 in the open position by the pressure of the mud flowing from the inlet assembly 110 toward the main-valve assembly 120.

FIGS. 1-12 depict one of the embodiments of this disclosure. Modification of this embodiment can be made without departing from the basic design and principle of operation.

In some other embodiments, the spring 129 is not used so that the main valve is closed by the force created by the mud flow from the servo valve chamber only.

In still other embodiments, the same components can be scaled up or down to suit different mud flow rates, mud flow pressure, etc. For example, the inner diameter of the collar housing the pulser can be in a range of 2.531" to 5.859", such as 3.469". The inner diameter of the collar in turn defines the outer diameter of the main valve assembly. The main valve seat has an orifice of 1.115" to 2.375" in size, such as 1.750". The first orifice in the servo valve chamber has a size of 0.125" to 0.375", such as 0.250". The second orifice of the servo-valve chamber has a size of 0.438" to 0.750", such as 0.594". The servo-valve plugging member has a stroke length of 0.250" to 0.750", such as 0.500".

Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

We claim:

1. A mud pulser, comprising:

an inlet assembly adapted to receive a mud stream;

a main-valve assembly that comprises a main valve, a main-valve shaft, and a main-valve conduit, wherein the main valve comprises a main-valve plugging member, a main valve seat adapted to receive the main-valve plugging member, and a main-valve chamber housing the main-valve plugging member, wherein the main-valve plugging member is affixed to the main-valve shaft, and wherein the main-valve conduit is arranged in the main-valve shaft and connected to the inlet assembly;

a servo-valve assembly that comprises a servo-valve, a servo-valve shaft, and a servo-valve conduit, wherein the servo-valve comprises a servo-valve plugging member and a servo-valve chamber housing the servo-valve plugging member and having a first orifice and a second orifice, wherein the servo-valve shaft is connected to the servo-valve plugging member and configured to be driven to perform a reciprocating linear movement that causes the servo-valve plugging member to alternately block the first orifice and the second orifice one at a time, and wherein the servo-valve conduit is connected to the servo-valve chamber and the main-valve assembly;

a motor assembly that comprises a motor connected to the servo-valve shaft and driving the servo-valve shaft to perform the reciprocating movement; and a collar that houses the inlet assembly, the main-valve assembly, the servo-valve assembly and the motor assembly, and forms a mud channel that receives a mud flow therein about the main-valve assembly, the servo-valve assembly and the motor assembly.

2. The mud pulser according to claim 1, wherein the inlet assembly further comprises a filter screen.

3. The mud pulser according to claim 1, wherein the main-valve assembly further comprises a piston affixed to the main-valve shaft, and a piston chamber that houses the piston and is connected to the servo-valve chamber through the servo-valve conduit.

4. The mud pulser according to claim 1, during operation, generates pressure changes in the mud flow by applying a force against the piston toward the inlet assembly when the servo-valve plugging member blocks the first orifice.

5. The mud pulser according to claim 3, wherein the main-valve assembly further comprises a spring that is housed in the piston chamber, wherein the spring is in contact with the piston.

6. The mud pulser according to claim 5, wherein the piston is mounted on the main-valve shaft in such a manner as to exert a first force to the main-valve shaft, and wherein the spring is arranged in such a manner as to exert a second force to the piston by being compressed by the pressure of the mud in a direction of the reciprocating movement of the main-valve shaft.

7. The mud pulser according to claim 1, further comprising a landing ring affixed to an inner surface of the collar, is connected to the servo-valve assembly or the motor assembly, and has an opening where the mud channel extends therethrough.

8. The mud pulser according to claim 1, wherein the servo-valve plugging member has a first end opposed to a second end, and the first end is configured to block the first orifice and the second end is configured to block the second orifice during the reciprocating linear movement of the servo-valve plugging member.

9. The mud pulser of claim 1, wherein the first orifice and the second orifice are disposed at two opposite ends of the servo-valve chamber, respectively.

* * * * *